United States Patent [19]

Eiland

[11] Patent Number: 4,872,379

[45] Date of Patent: Oct. 10, 1989

[54] ROCKBIT ARM MACHINING FIXTURE AND METHOD

[75] Inventor: Eddie L. Eiland, Red Oak, Tex.

[73] Assignee: Dresser Industries, Inc., Dallas, Tex.

[21] Appl. No.: 485

[22] Filed: Jan. 5, 1987

[51] Int. Cl.[4] ..... B23B 33/00

[52] U.S. Cl. ..... 82/165; 76/108 A; 51/217 A; 269/50; 269/902

[58] Field of Search ..... 76/108 A; 269/50, 52, 269/258, 282, 283, 902; 82/40 R; 51/217 A; 279/5

[56] References Cited

U.S. PATENT DOCUMENTS

| | | | |
|---|---|---|---|
| 2,046,238 | 6/1936 | Balsiger | 82/40 |
| 3,998,445 | 12/1976 | Goltz | 269/902 |
| 4,612,735 | 9/1986 | Millay | 269/902 |

*Primary Examiner*—Frederick R. Schmidt

[57] ABSTRACT

A fixture and method are disclosed for machining the bearing spindle on rockbit drilling arm forgings. The teachings of the invention eliminate the need for shims, greatly simplify the set-up process and reduce the amount of different fixtures necessary to accomplish positioning a forging. In addition, the device disclosed performs the offset and twist adjustment operations simultaneously.

14 Claims, 3 Drawing Sheets

ROCKBIT ARM MACHINING FIXTURE AND METHOD

TECHNICAL FIELD

The present invention relates to a fixture and a method for rockbit arm machining. More particularly, the invention relates to simplification of the machining of the bearing spindle on a rockbit arm.

BACKGROUND ART

Prior methods of machining the bearing spindle on a rockbit drilling arm were costly and required considerable machining skill to obtain satisfactory results. Machine operators using prior manufacturing methods had to account for five varibles, two angular and three linear, in positioning the rockbit arm forging. Because a given forging could be used to generate a variety of final configurations, elaborate fixtures have been used to adjust the positioning of the forging in accordance with the desired final configuration. Prior art fixtures, besides requiring a multiplicity of interchangeable spacer plate sets to accommodate various rockbit arm configurations, make use of shims to accomplish small adjustments. Shims are undesirable because, owing to the interrelationship between the aforementioned variables, a shim used to adjust one of the variables would affect the other dimensions which define the position of the rockbit arm prior to machining. Shim use in this type of machining is therefore associated with high part rejection rate and time consuming trial and error.

SUMMARY OF THE PRESENT INVENTION

It is an object of the present invention to provide a method and apparatus for rockbit arm machining which saves time over prior art methods.

It is a further object of the present invention to reduce the rejection rate in the machining of bearing spindles on rockbit arms.

It is yet another object of the present invention to simplify the fixturing and set-up of rockbit arm machining, eliminating shims and interchangeable plate sets and thereby reducing errors due to machine operator judgment.

Accordingly, a machining fixture is provided which includes a vee block, having an outside radius and an adjustable locating pin, which cooperates with a cap adapted to receive the vee block within a cylindrical bore.

DESCRIPTION OF THE PREFERRED EMBODIMENT

Figure 1:
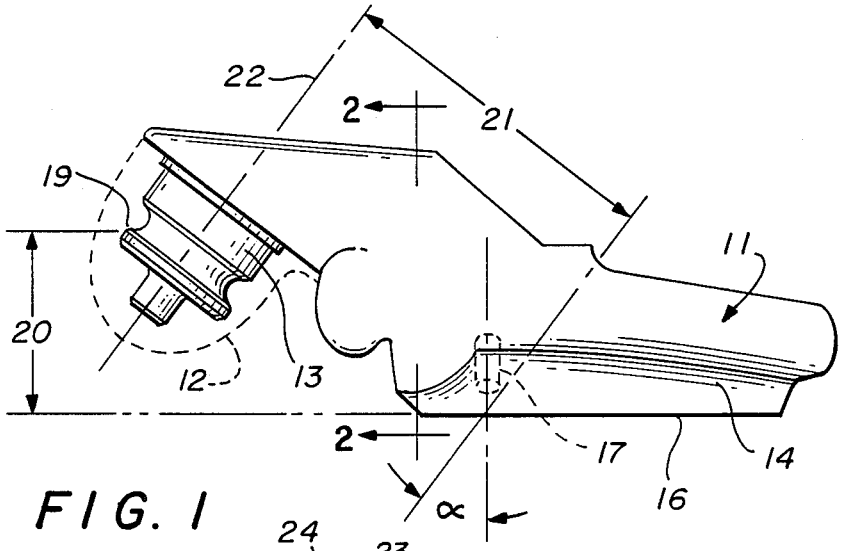
FIG. 1 shows a side elevation of a rockbit drilling arm.

FIG. 1 shows a partially machined rockbit drilling arm 11. Three such arms are joined to form a complete rockbit. An arm is made from a forging. Each forging has a bulbous protrusion 12 at one end from which a bearing spindle 13 is machined. Each forging also bears a vee surface, a v-shaped surface composed of two flat sides 14, 15 and an apex edge 16. A tooling hole 17 is drilled in the forging. The apex edge of the forging 16, the flat sides 14, 15 and the tooling hole 17 are used as reference points for later machining operations.

The orientation of the bearing spindle 13 with respect to the forging is defined by five variables. The five variables are pin angle, twist, offset, ball race height and pin turn radius. Pin angle d is defined as the angle between the center line 22 of the bearing spindle 13 and the plane perpendicular to the apex edge. Ball race height 20 is defined as the distance between the inner extremity of the ball race 19 and the projected extension of the apex edge 16. Pin turn radius 21 is defined as the distance between the center line of the tooling hole 17 and the center line 22 of the bearing spindle 13. The center line of the bearing spindle coincides with the center line 31 of the rotary cutting tool axis.

Figure 2:
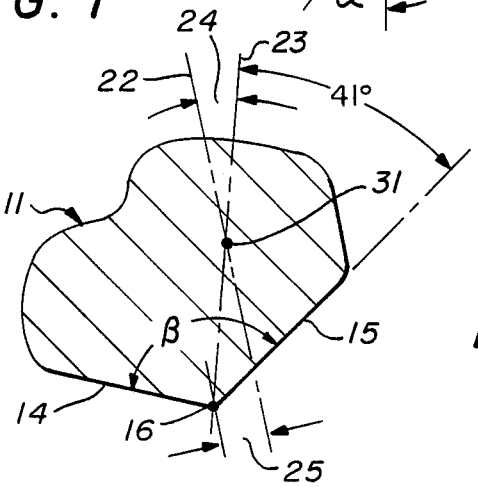
FIG. 2 shows a cross-section through lines 2—2 in FIG. 1 of a rockbit drilling arm. Twist and offset measurements are illustrated.

A representation of the other two orientation variables is depicted in FIG. 2. The center line 23 of the arm 11 is selected as being 41° from the vee surface 15. The center line 23 appears as a line in a cross-section such as FIG. 2, but it may be thought of as a plane which runs into the plane of the drawing of FIG. 2, and which plane is defined as being 41° from the planar vee surface 15. The twist angle 24 is illustrated as the angle between the center line 23 of the arm 11 and the center line 22 of the bearing spindle 13. Similar to the center line of the arm 23, the center line of the bearing spindle 22 projects a plane perpendicular to the illustration in FIG. 2. Thus, the intersection of these two projected planes forms a rotational center line for the vee block 29, which when seen in a cross-section, such as FIG. 2, appears as a point 31. The offset measurement 25 is seen as the distance between the center line 22 of the bearing spindle 13 and the apex 16.

Figure 3:
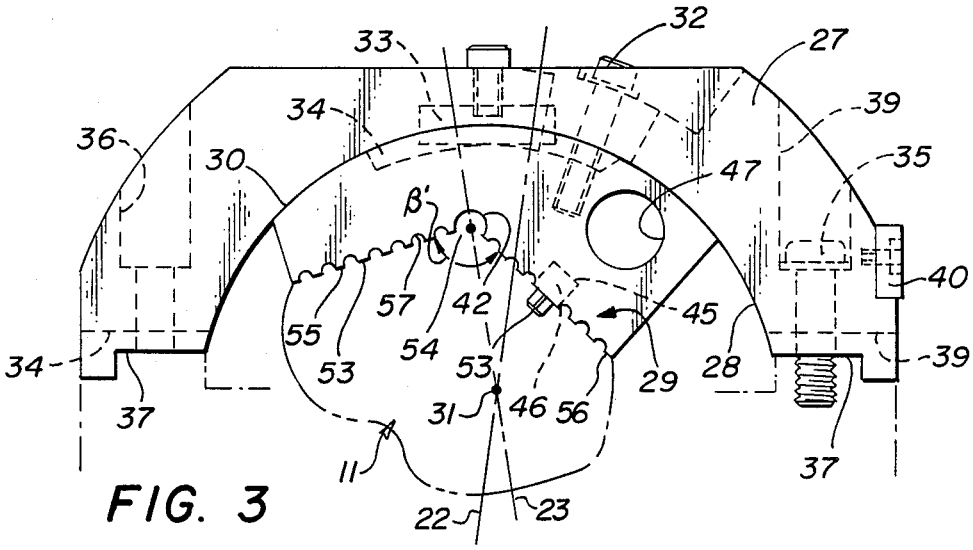
FIG. 3 shows, in front elevation, the v-shaped block and the cap of the present invention. Also shown are the vee block keyway and means of attachment between vee block and cap, and between cap and base.

In FIG. 3, a device is shown which is used to orient the rockbit arm beneath the cutting tool of a vertical lathe. A cap 27 is provided which has an interior arcuate surface 28. A vee block 29 rests within this surface. The curvature of the arcuate exterior 30 of the vee block 29 and the interior surface 28 are the same. The center of the circle described by the radius of each surface 28, 29 is the intersection of the center line 23 of the arm 11 and the center line of the bearing spindle 22. This point 31 is depicted in FIGS. 1 and 2. The cap 27 is further provided with three bolts 32 which are used to position the vee block within the cap by allowing the rotation of the block within the arcuate surface 28, when the bolts are loose. A key 33 is provided in the cap, which engages a keyway 34 in the vee block. Six bolts 35 are provided within recesses 36. Three bolts 35 are placed on each side of the cap to hold the cap onto a base 26, seen more clearly in FIG. 4. The cap is also seen to have a longitudinal guide 37, on each side, which locates the cap on the base 26. A transverse key 38 on the base, shown in FIG. 4, engages a keyway 39 on the cap, providing further positioning. A reference surface 40 is located on one side of the cap. The vee block 29 has two ground planar interior faces 55, 56 which converge to an apex having an included angle $\beta'$ generally corresponding to the included angle $\beta$ formed by the sides 14, 15 of the arm 11.

Figure 5:
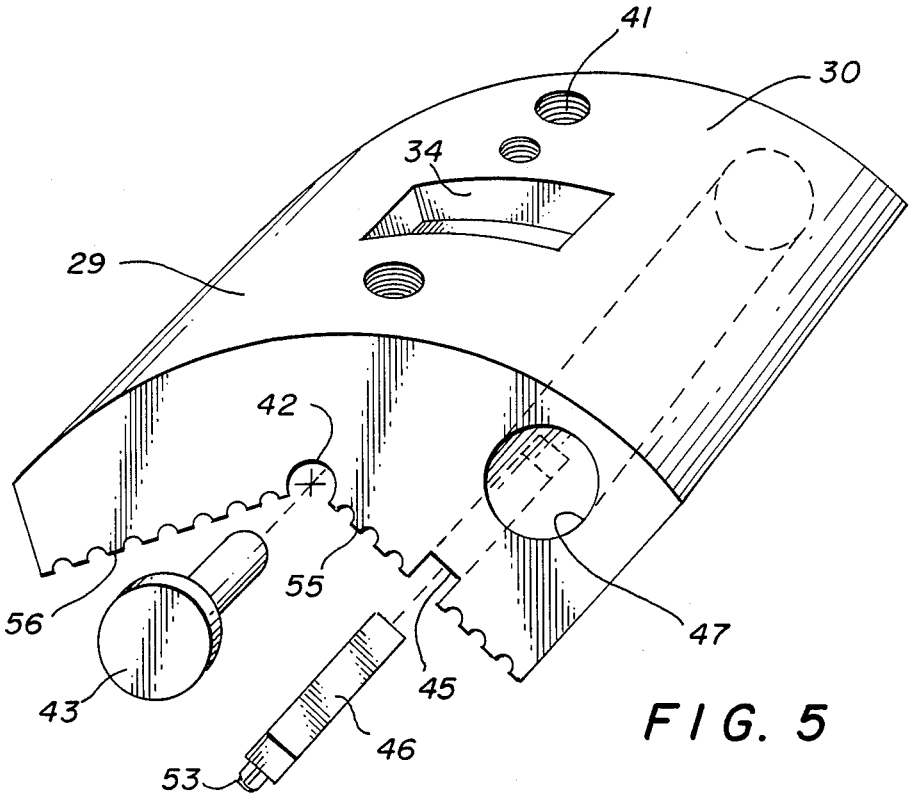
FIG. 5 shows, in exploded isometric perspective, the vee block, locator and test pin.

FIG. 5 shows that the vee block further includes three tapped holes 41 for engaging the bolts 32 which hold the vee block and cap together. A pilot bore 42 is located in axial alignment with the apex of the junction of the flat surfaces 55, 56 of the vee block. The pilot base is co-axial with the apex axis 54, formed by the intersection of the two flat faces 55, 56. A test pin 43 is temporarily introduced into the pilot bore 42 prior to machining the arm 11 so that the center line 54 of the pilot bore 42 can be located with respect to the outer surface 44 of the reference surface 40 with the use of a depth micrometer. A channel 45 is locate on one interior surface 55 of the vee block. A locator 46 having a pin 53 fits in the channel and is held in place by bolts. A void 47 is provided in the vee block to reduce the weight of the piece. Longitudinal grooves 57 and similar grooves perpendicular to these form a raised gripping surface on the faces 55, 56 of the vee block which aid in holding the forgings in place accurately.

Figure 4:
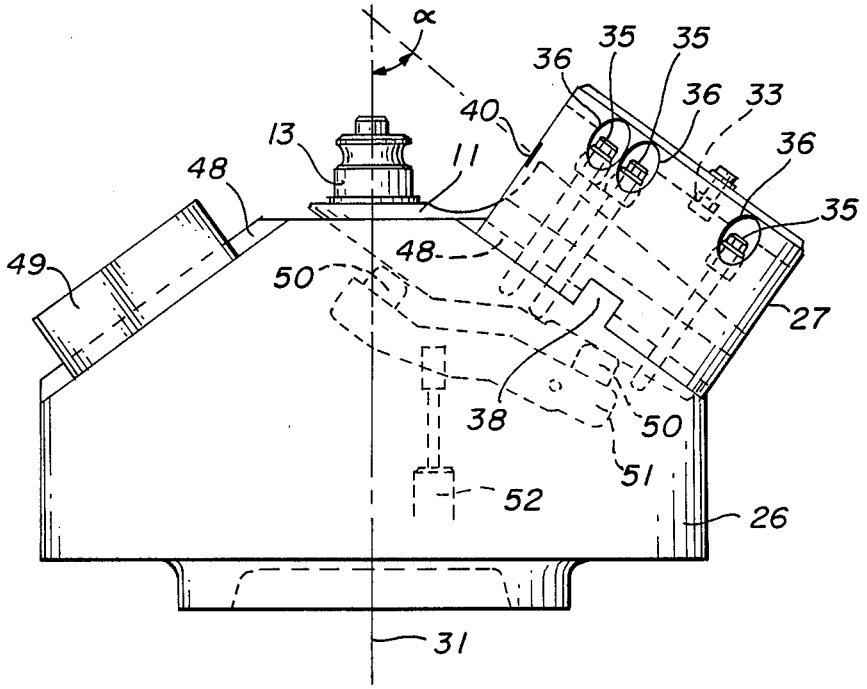
FIG. 4 shows, in front elevation, the arrangement of rockbit arm, bearing spindle, vee block, cap and base.

In FIG. 4, the base 26 is shown supporting the rockbit arm as it would during the bearing spindle machining process. Two sets of rails 48 are located on the base. One set engages the guides 37 of the cap. The other set engages a counterweight used to stabilize the rotating base. The cap 27 is bolted onto the base by six bolts 35. The vee block 29 is then affixed and adjusted. The rockbit arm forging 11 is inserted into the base so that it rests upon two bumpers 50 located on a pusher 51. The machine operator activates a hydraulic cylinder 52 which drives the pusher upwardly. Thus, the v surfaces 14, 15 of the rockbit arm forging are held firmly in place against the interior surfaces 55, 56 of the vee block 29. The pin of the locator 46 engages the tooling hole 17 in the forging. The forging 11 is now firmly located and orientable relative to the center line of the machine 31.

Adjustment of the five definitional variables is accomplished in the following ways. Pin angle d is changed by providing vee blocks 29 whose apex axis 54 is inclined to its exterior surface 30 by varying degrees. One vee block is required for each pin angle desired of a given forging.

Offset is adjusted by rotating the vee block within the cap, and is measured by the displacement of the test pin 43 from the reference surface 40 on the cap. The test pin 43 is removed after the vee block is concurrently obtained. Twist is adjusted by the offset adjustment procedure, because the rotational center 31 of the vee block is located at the intersection of the rockbit arm center line 23 and the bearing spindle center line 22 as shown in FIG. 2. The pin turn radius is adjusted by providing various locators 46, each having a different location for the pin 53. It should be noted that pin turn radius changes only insignificantly when pin angle is varied because the apex axis of the interchangeable vee blocks 54, once in place, intersect at a point close to the average pin turn radius. The nominal pin turn radius is defined as either the average or median pin turn radius within the range of pin turn radii designated for a group of forgings of the same size.

Figure 6:
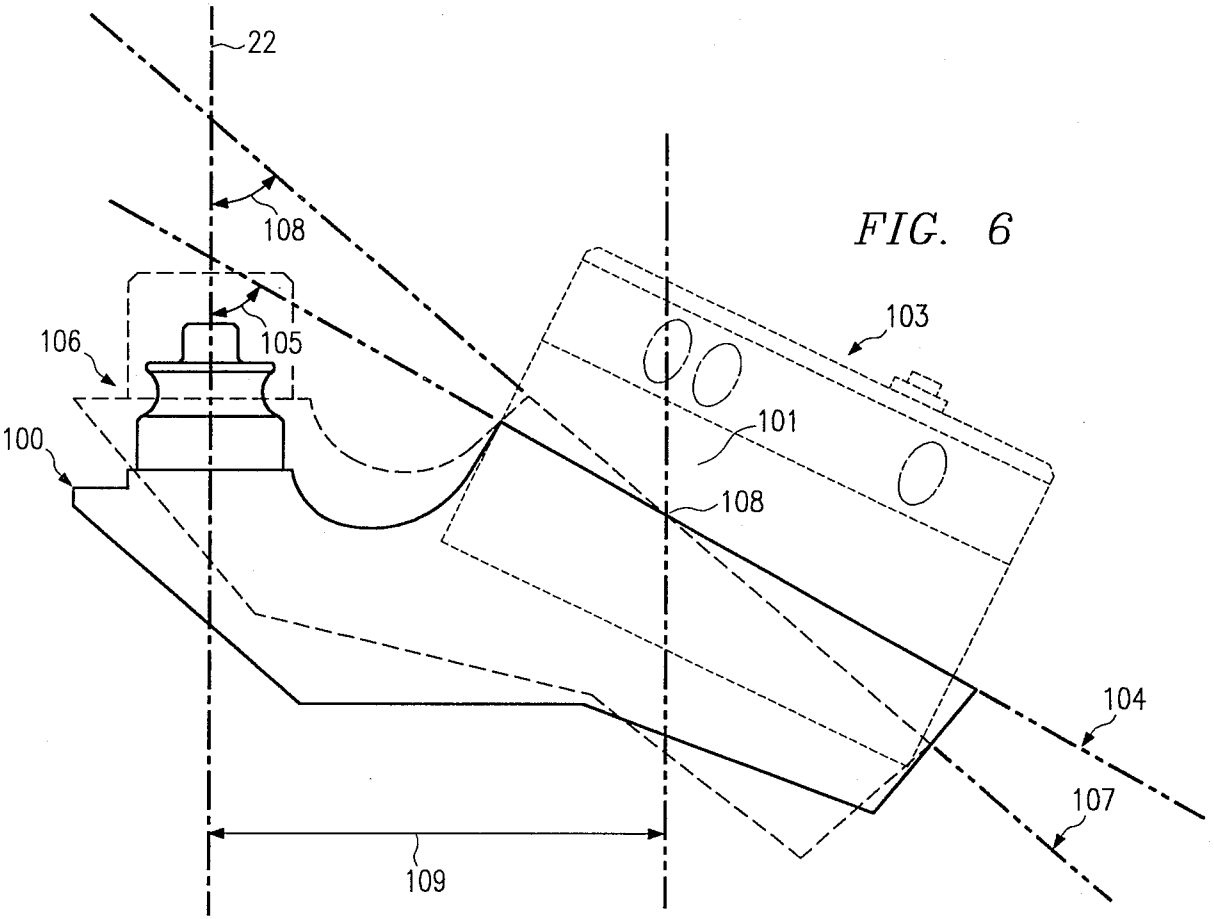
FIG. 6 shows in schematic side elevation, the relationship between average pin turn radius and apex axis, with respect to two different rockbit arm forgings which are machined using two different vee blocks.

This feature is illustrated in FIG. 6. As seen there, a first forging 100 is positioned by a first vee block 101 which is in turn restrained by a cap 103, as previously described. The apex edge of the first forging coincides with the apex axis 104 of the first vee block, making an angle 105 with reference to the center line 22 of the bearing spindle. A second forging 106 may be machined using a second vee block which is received by the cap after the first vee block has been removed. The apex edge of the second forging coincides with the apex axis 107 of the second vee block, making a second angle 108 with reference to the center line 22. The first and second vee blocks are thus fabricated such that in the installed position, the apex axes 104, 107 intersect at a point 108 roughly equal to the average pin turn radius 109. The remaining variable is ball race height. When the other variables are properly calculated and when a rockbit arm forging is set up properly according to the other variables, the proper ball race height is automaticlly achieved.

While we have described above the principles of our invention in connection with specific process steps and equipment, it is understood that this description is made only by way of example and not as a limitation to the scope of the invention as set forth in the objects thereof and in the accompanying claims.

What I claim is:

1. A fixture for holding a rockbit arm forging during the machining operations which result in pin angle, ball race height twist angle, offset and pin turn radius, the fixture comprising:

a cap having an interior arcuate surface adapted to rotatably receive a removable vee block;

a removable vee block, having an exterior arcuate surface, first and second interior surfaces, an apex axis corresponding to a predetermined pin angle, the vee block adapted to removably receive a locator; and a removable locator having a pin, the pin defining a pin turn radius.

2. A machining fixture of claim 1, wherein:

the vee block is adapted to receive a rockbit forging having an arm center line and a bearing spindle center line; and the interior arcuate surface of the cap and the exterior arcuate surface of each vee block define a section of a cylindrical interface whose central axis passes through the intersection of the rockbit arm center line and the bearing spindle center line.

3. The machining fixture of claim 2, wherein:

at least one of the interior surfaces of the vee block has formed therein a channel, the channel receiving a locator.

4. The machining fixture of claim 3, wherein:

the fixture further includes one or more auxiliary vee blocks, wherein each vee block is adapted to be installed in the cap, the cap adapted to receive one vee block at a time;

the apex axes of two or more vee blocks, when installed, intersect at the nominal pin turn radius.

5. The machining fixture of claim 5, wherein:

at least one vee block further comprises a bore coaxial to the apex axis, the bore removably receiving a test pin; and the cap further comprises a reference surface from which the distance to the test pin may be precisely determined.

6. The machining fixture of claim 4, wherein:

the cap further comprises a key; and the vee block has formed therein a keyway.

7. A method of orienting a rockbit forging according to pin angle, twist, offset, ball race height and pin turn radius comprising the steps of:

drilling a tooling hole in the forging;

selecting a vee block according to the required pin angle;

selecting a locator according to the required pin turn radius and inserting it in the vee block;

rotating the vee block within a cap on a base to achieve both offset and twist adjustments simultaneously; and placing the forging within the vee block so as to engage the locator with the tooling hole.

8. The method of claim 8, further comprising the step of:

providing a plurality of vee blocks, each having an apex axis corresponding to a particular pin angle, the apex axes of the various vee blocks coinciding, when mounted in the cap, at a point proximal to the nominal pin turn radius.

9. The method of claim 8, wherein:

the forging further comprises an arm center line and a bearing center line; and adjusting the vee block further comprises:

rotating the selected block about the intersection of the arm center line and the bearing center line.

10. The method of claim 9, wherein:

the cap further comprises a reference surface;

the selected vee block has formed therein a bore co-axial to the apex axis adapted to receive a test pin; and adjusting the vee block further comprises:

inserting the test pin in the bore; and rotating the vee block within the bore;

measuring the distance between the test pin and the reference surface; and readjusting the vee block until the desired displacement between test pin and reference surface is achieved.

11. A fixture for machining rockbit arm forgings having an apex, an arm center line, a bearing center line, and a tooling hole formed therein comprising:

a removable vee block rotatable about the intersection of the arm center line and the bearing center line, the vee block having an apex axis angle, the apex angle inclined with respect to the bearing center line, the apex axis angle corresponding to a predetermined pin angle;

the vee block rotatably received by a cap, means for securing said vee block to said cap at a designated rotational position relative to said cap, the cap and vee block revolving in unison about the bearing center line, the bearing center line coincident with a rotational axis of a machine in which the fixture is utilized; and means for urging the forging into position against the vee block during machining.

12. The fixture of claim 11, wherein:

the vee block has formed therein a channel adapted to receive one or more interchangeable locators.

13. A fixture for machining rockbit arm forgings having an apex, an arm center line, a bearing center line, and a tooling hole formed therein comprising:

a removable vee block rotatable about the intersection of the arm center line and the bearing center line, the vee block having an apex axis angle, the apex axis angle corresponding to a predetermined pin angle;

the vee block rotatably received by a cap, the cap and vee block revolving in unison about the bearing center line, the bearing center line coincident with a rotational axis of a machine in which the fixture is utilized;

means for urging the forging into position against the vee block during machining;

the vee block having formed therein a channel adapted to receive one or more interchangeable locators; and the vee block having formed therein a bore co-axial to an apex axis, the bore adapted to receive a test pin.

14. A rotating machining fixture for holding a rockbit arm having a locator hole, an apex axis, a center line and a bearing centerline, the fixture comprising:

a base;

a cap having an interior arcuate surface;

a vee block having an exterior arcuate surface which cooperates adjustably with the arcuate surface of the cap, the vee block having first and second interior planar surfaces, the intersection of the planar surfaces defining a pre-established apex axis, one of said planar surfaces having a channel formed therein;

a locator comprising a base portion adapted to fit within the channel, and a pin adapted to be received by the locator hole in the rockbit arm;

an arcuate junction between the cap and the vee block defining an arc of a circle, the circle having a center coincident with the intersection of the centerline of the rockbit arm and the bearing centerline of that rockbit arm; and means for rotationally positioning and securing the vee block within the cap;

whereby, the predetermined pin turn radius is achieved by placement of the rockbit arm within the vee block so that the locator hole receives the pin, a predetermined pin angle is obtained by the apex angle of the vee block, a predetermined offset and twist are simultaneously obtained by rotating the vee block within the cap, and whereby a predetermined ball race height is achieved without further adjustment of the rockbit arm as a result of obtaining the aforementioned variables.

* * * * *